US006792858B2

(12) United States Patent
Kolbe et al.

(10) Patent No.: US 6,792,858 B2
(45) Date of Patent: Sep. 21, 2004

(54) DEVICE FOR HANDLING PRINTING CYLINDER SLEEVES

(75) Inventors: Wilfried Kolbe, Gülzow (DE); Klaus Schirrich, Bielefeld (DE); Andreas Kückelmann, Ibbenbüren (DE); Wolfgang Brusdeilins, Bielefeld (DE)

(73) Assignee: Fischer & Krecke GmbH & Co., Bielefeld (DE)

( * ) Notice: Subject to any disclaimer, the term of this patent is extended or adjusted under 35 U.S.C. 154(b) by 8 days.

(21) Appl. No.: 10/427,490

(22) Filed: May 1, 2003

(65) Prior Publication Data

US 2003/0213389 A1 Nov. 20, 2003

(30) Foreign Application Priority Data

May 18, 2002 (EP) ..... 02011105

(51) Int. Cl.[7] ..... B41F 27/06

(52) U.S. Cl. ..... 101/376; 101/375; 101/479; 29/278; 29/272; 29/281.1; 29/282

(58) Field of Search ..... 101/375, 376, 101/479; 29/278, 280, 272, 281.1, 282

(56) References Cited

U.S. PATENT DOCUMENTS

| | | | | | |
|---|---|---|---|---|---|
| 4,030,415 | A | * | 6/1977 | Fellows | 101/382.1 |
| 4,823,693 | A | * | 4/1989 | Kobler | 101/218 |
| 4,913,048 | A | * | 4/1990 | Tittgemeyer | 101/141 |
| 5,745,968 | A | | 5/1998 | Genest et al. | |
| 5,802,975 | A | * | 9/1998 | Prem et al. | 101/375 |
| 6,386,103 | B1 | * | 5/2002 | Charette et al. | 101/375 |

FOREIGN PATENT DOCUMENTS

| | | |
|---|---|---|
| DE | 470937 | 2/1929 |
| EP | 1093914 | 4/2001 |
| GB | 461782 | 2/1937 |

* cited by examiner

*Primary Examiner*—Andrew H. Hirshfeld
*Assistant Examiner*—Andrea H. Evans
(74) *Attorney, Agent, or Firm*—Richard M. Goldberg

(57) ABSTRACT

A device for handling sleeves (20) for cylinders of printing presses, wherein a carrying tube (26) is provided, on which a mounting device (28), engaging these sleeve (20), is disposed for mounting the sleeve in a position, which is aligned coaxially with the carrying tube.

14 Claims, 1 Drawing Sheet

DEVICE FOR HANDLING PRINTING CYLINDER SLEEVES

BACKGROUND OF THE INVENTION

The invention relates to a device for handling sleeves for cylinders of printing presses.

Printing presses usually have a plurality of cylinders, for example, printing cylinders, inking rollers and the like, which occasionally must be exchanged, for example, when changing over a printing press for a different printing order. Changing systems are known, for which the cylinders in the printing press are clamped hydraulically or pneumatically on one axle, which remains mounted on one side in the printing press during a change of cylinders, so that the cylinders can be pulled off and slipped on axially. In this case, the cylinders have a continuous coaxial channel, through which the axle, attached to the machine, passes when the cylinders are installed in the printing press. This continuous channel can also be used for handling the cylinders outside of the printing press, in that the whole of the logistics system for the preparation, storage, transport and installation of the cylinders is equipped with holding devices, which in each case have an essentially horizontal, freely protruding pin, onto which the cylinders can be pushed.

On the other hand, so-called sleeve systems are known, for which each cylinder consists of a core and a detachable sleeve, which has been slipped onto the core. It is then not necessary to change the whole cylinder when the printing machine is changed over. Instead, only the sleeve is pulled off and replaced by a different one, while the cylinder core remains in the printing press. The sleeves generally have a relatively thin wall and, in any case, a relatively large internal cross-section, which corresponds to the external cross section of the cylinder core and is clearly larger than the internal cross section of the channel mentioned above. Until now, the sleeve has generally been pulled off and slipped onto the cylinder core manually. However, in the EP-A-1 090 754, a device is described, which is installed in the printing press and with which the pulling off of the sleeve from the core and the slipping on of the sleeve onto the cylinder core can be automated partly.

SUMMARY OF THE INVENTION

It is an object of the invention to provide a device, which facilitates the handling of the sleeve outside of the printing press.

Pursuant to the invention, this objective is accomplished by a carrying tube, on which a mounting device, engaging the sleeve, is disposed for clamping the sleeve in a position aligned coaxially with the carrying tube.

By means of the mounting device, the sleeve is connected with the carrying tube so that the latter extends coaxially through the sleeve. Consequently, the sleeve can then be held at the carrying tube and transported without, exposing the relatively thin-walled sleeve to deformational forces, which could damage the sleeve. Overall, the configuration of sleeve and handling device then corresponds to a complete cylinder with a continuous coaxial channel of the type described above, the channel being formed by the internal cross section of the carrying tube. The sleeve, with the handling device, can therefore be slipped in the same manner as the complete cylinder onto a pin of a handling robot, of a transporting carriage, a shelf, and the like.

The inventive solution accordingly makes it possible to use the logistics system, which is already in existence for the cylinder of the printing press, in the same way for the sleeve. Accordingly, printing cylinder sleeves, for example, before or after the blocks are glued on, can be mounted on the inventive handling device and, with the help of this handling device, then slipped onto a pin-like holder of a transporting carriage, with which they are transported to a storage area. The storage area may, in turn, have pin-like holding devices, onto which complete printing cylinders or the sleeves, provided with the handling device, can be slipped as required. In the case of a fully or semi-automatic storage area, a handling device may be provided, which approaches the storage places (pins) which are disposed next to and above one another, in order to store the sleeve or the printing cylinder at the desired storage site or to remove them from the storage area. The handling device, in turn, may also have a pin, which engages the channel of the printing cylinder or the carrying tube of the handling device for the sleeves. The sleeves, which are taken from the storage area and required for use in the printing press, can be transferred with the help of the handling device onto a carriage, which is once again equipped with pin-like holders, and carried with these to the printing press, where they are slipped onto the cylinder cores. Similarly, the sleeves, removed from the printing press, can be stored once again in the storage area.

Advantageous developments of the invention arise out of the dependent claims.

Preferably, the mounting device is disposed at one end of the carrying tube, on which, at a distance from the mounting device, a disk-shaped supporting element is disposed, which is surrounded with little clearance by the mounted sleeve. By these means, excessive deformation of the sleeve is avoided in the event that external forces, after all, act directly on the sleeve. Moreover, the sleeve can be slipped on to the cylinder core in the printing press more easily due to the supporting element If the sleeve is to be slipped on, the carrying tube of the handling device is aligned coaxially with the cylinder core in the printing press, the mounting device is loosened and the sleeve is pushed manually or automatically by the handling device onto the cylinder core, the supporting element preventing any tilting of the sleeve as long as it has not yet been pushed far enough onto the cylinder core.

Accordingly, especially the handling of sleeves is facilitated and the sleeves may have a length of 2000 mm or more, depending on the printing width of the printing press.

In accordance with a further development of the invention, a centering piece may be provided at the free end of the carrying tube and can be coupled to an axle stub of the cylinder core or to the end of an axle, mounted on the machine and passing through the cylinder core. In this way, a precise alignment of the sleeve in relation to the cylinder core is achieved, so that the sleeve can then be slipped effortlessly onto the cylinder core.

BRIEF DESCRIPTION OF THE DRAWINGS

In the following, examples of the invention are explained in greater detail by means of the drawing, in which.

DETAILED DESCRIPTION

Figure 1:
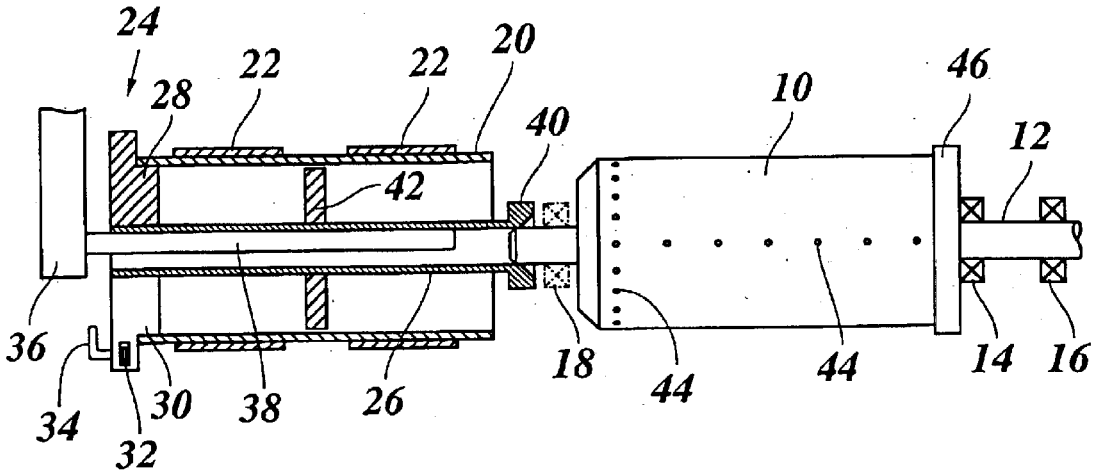
FIG. 1 shows an axial section through a handling device, on which a sleeve is mounted and with a cylinder core, which is mounted in a printing press and on which the sleeve is to be slipped.

FIG. 1 shows a side view of a cylinder core 10 of a printing press, the cylinder core being fastened to an axle 12 attached to the machine. The axle 12 is mounted on one side of the cylinder core 10, on the right in FIG. 1, in two bearings 14, 16, so that it cannot tilt. At the opposite end of the cylinder core 10, the axle 12 is mounted in a removable bearing 18. This bearing is loosened and removed when the cylinder core 10 is to be pulled off from the axle 12 or when a sleeve 20 is to be slipped onto the cylinder core 10, remaining in the machine. After the bearing 18 is removed, the axle 12 and the cylinder core 10 are held in cantilever fashion by the two bearings 14, 16, so that the sleeve 20 can be slipped on from the free end without hindrance.

In the examples shown, the sleeve 20, which is shown in axial section in FIG. 1, is a printing cylinder sleeve, on the outer peripheral surface of which several blocks 22 are fastened in the known manner. Alternatively, the sleeve 20 could also be for an anilox roller of a flexographic printing press.

Figure 2:
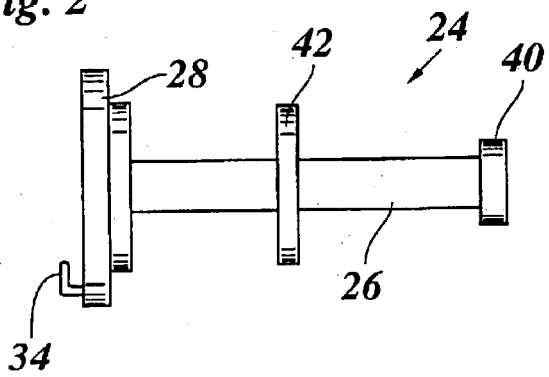
FIG. 2 shows a side view of the handling device.
Figure 3:
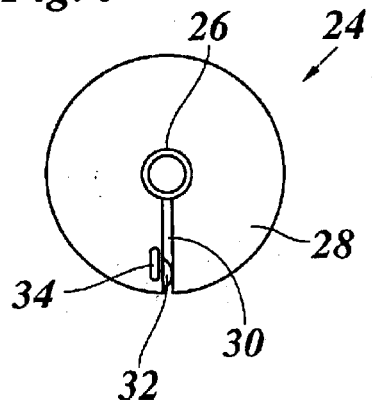
FIG. 3 shows a front view of the handling device.

The sleeve 20 is held on a handling device 24. This handling device has a carrying tube 26, on the one end of which a mounting device 28 is fastened. The mounting device 28 has the shape of a stepped disk, which, with its section of reduced diameter, engages the end of the sleeve 20 and which, at a place on its circumference, is interrupted by a slot 30, which extends from its central opening to the outer peripheral edge, as is evident more clearly in FIGS. 2 and 3. An eccentric 32 is mounted in the wall of the slot 30 and, with the help of a tensioning lever 34, can be braced against the opposite wall of the slot in this way, the disk, as a whole, is expanded somewhat so that its part, engaging the sleeve 20, can be braced firmly against the inner surface of the sleeve. By these means, the sleeve 20 is held in a freely protruding position, oriented coaxially with the carrying tube 26.

The handling device 24, in turn, is slipped detachably onto a holder 36, which has a pin 38 that engages the carrying tube 26.

With the help of the holder 36, which can be part of a handling robot or a transporting carriage or the like, the handling device 24 with the braced sleeve 201 is moved to the printing press, so that the carrying tube 26 is aligned essentially coaxially with the axle 12 of the printing press. A centering piece 40, which is provided with an internal cone and is located at the free end of the carrying tube 26, facilitates the coupling of the end of the carrying tube to the axle 12, so that a precise alignment of the sleeve 20 on the cylinder core 10 is achieved.

A disk-shaped supporting element 42 is fastened on the carrying tube 26 at a distance from the mounting device 28, namely, at about half the length of the sleeve 20 in the examples shown, and is surrounded with little clearance (for example, of the order of 1 mm) by the internal surface of the sleeve 20.

In order to slip the sleeve 20 onto the cylinder core 10, the mounting device 28 is first of all loosened with the help of the tensioning lever 34. Subsequently, the sleeve 20 is shifted manually in the direction of the cylinder core 10, so that the previously clamped end of the sleeve slides off from the mounting device 28. The sleeve is then held in position by the supporting element 42 without any radial shifting worth mentioning. When the sleeve is shifted further, its other end slides onto the starting incline at the end of the cylinder core 10, so that the sleeve is centered once again precisely on the cylinder core 10.

Figure 4:
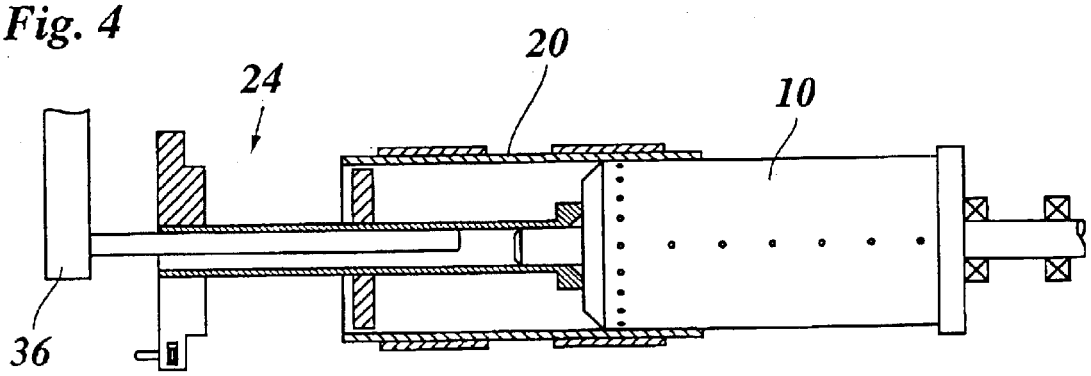
FIG. 4 shows a representation, similar to that of FIG. 1, while the sleeve is being slipped onto the cylinder core

The cylinder core 10, in a known manner, has a compressed air system with air outlets 44 in the peripheral surface. The compressed air system is supplied with compressed air over the axle 12. The air outlets 44 are disposed particularly on a rim immediately adjoining the free end of the cylinder core 10. As soon as the end of the sleeve 20 has been slipped onto this end of the cylinder core, the compressed air, emerging from the air outlets 44, slightly expands the sleeve, so that the sleeve can be slipped further, on a cushion of air and with little friction, onto the cylinder core 10, as shown in FIG. 4. When the sleeve 20 has been slipped on completely and lies against a stop 46 at the end of the cylinder core 10, the supply of compressed air is interrupted, so that the sleeve shrinks and then is seated firmly on the cylinder core, 10. The handling device 24 is then moved away with the help of the holder 36.

By reversing the processes described above, the sleeve 20 can also be pulled off once again from the cylinder core 10 and transferred once more to the, handling device 24, so that it can be transported to a storage area or the like.

For the end phase of the slipping-on movement of the sleeve 20 onto the cylinder core 10, as well as for the initial phase of the movement when the sleeve is pulled from the cylinder core, an auxiliary device, installed in the printing press, can also be used. This auxiliary device pulls the sleeve, which has been slipped on partly, completely against the stop 46 and/or slides the sleeve, which is to be pulled off, some distance further from the stop 46, as is described in the EP-A-1 090 754.

Optionally, it is also possible to automate the sleeve-changing process further, for example, by providing the above-described handling device 24 with an actuating drive, such as, a hydraulic or pneumatic drive, which shifts the mounting device 28 on to the carrying tube 26, in order to slip the sleeve onto the cylinder core. Optionally then, the supporting element 42 should also be displaceable, so that, together with the mounting device 28, it can be shifted in the direction of the free end of the carrying tube 26. During the reverse movement of the mounting device 28 into the starting position, the supporting element 42 can be carried along magnetically, for example, until it comes up against a stop in its starting position, whereas the mounting device 28 alone then moves further to the end of the carrying tube 26.

Instead of the tensioning lever 34, it is also possible to provide a pneumatic or electromechanical device for mounting or loosening the mounting device 28.

Finally, it is also possible to affix at or in the handling device 24, for example at or in the disk forming the mounting device 28, a preferably pre-programmable coding, perhaps in the form of a semiconductor component or in the form of a transponder, which makes it possible to identify the sleeve 20 and/or the place, at which it is stored in the storage area, and which can be read automatically by a reading device, which is intergrated in the holder 36.

Figure 5:
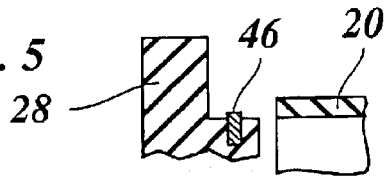
FIGS. 5 and 6 show partial sections through a handling device of a different embodiment.
Figure 6:
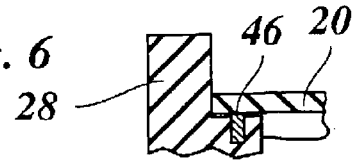

FIG. 5 shows a different embodiment of a mounting device 24. The disk is not interrupted here by a radial slot and instead, in the part of reduced diameter, has a locking ring 46 of an elastic material, such, as a rubber, which is inserted in a peripheral groove and protrudes somewhat beyond the peripheral area. When the sleeve 20 is pushed onto this peripheral area, as shown in FIG. 6, the locking ring is compressed so that it holds the sleeve in position.

What is claimed is:

1. A device for handling sleeves for cylinders of printing presses, comprising:

a carrying tube;

a mounting device on the carrier tube at one end thereof for engaging the sleeve to mount the sleeve in a position, which is aligned coaxially with the carrying tube, the mounting device being in the form of a stepped disk, which forms a stop for an end of the sleeve and includes a section which is reduced in diameter, and which engages the end of the sleeve, and wherein the disk of the mounting device has a radial slot; and a device for expanding this slot and, with that, expanding the disk.

2. The device of claim 1, wherein the device for expanding the slot includes an eccentric for engagement within the slot to expand the slot.

3. The device of claim 2, further comprising a supporting element for the sleeve disposed on the carrying tube at a distance from the mounting device.

4. The device of claim 2, wherein a free end of the carrying tube has a centering piece for centering the carrying tube on a cylinder core, onto which the sleeve is to be slipped.

5. The device of claim 1, further comprising a supporting element for the sleeve disposed on the carrying tube at a distance from the mounting device.

6. The device of claim 5, wherein the supporting element has a shape of a disk, which is adapted to be surrounded with little play by an inner surface of the sleeve.

7. The device of claim 1, wherein a free end of the carrying tube has a centering piece for centering the carrying tube on a cylinder core, onto which the sleeve is to be slipped.

8. A device for handling sleeves for cylinders of printing presses, comprising:

a carrying tube; and a mounting device on the carrier tube at one end thereof for engaging the sleeve to mount the sleeve in a position, which is aligned coaxially with the carrying tube, the mounting device being in the form of a stepped disk, which forms a stop for an end of the sleeve and includes a section which is reduced in diameter, and which engages the end of the sleeve, and wherein the disk of the mounting device, in its section of reduced diameter, has a locking ring, which is inserted in a peripheral groove of the disk.

9. The device of claim 8, further comprising a supporting element for the sleeve disposed on the carrying tube at a distance from the mounting device.

10. The device of claim 8, wherein a free end of the carrying tube has a centering piece for centering the carrying tube on a cylinder core, onto which the sleeve is to be slipped.

11. A device for handling sleeves for cylinders of printing presses, comprising:

a carrying tube, a free end of the carrying tube having a centering piece for centering the carrying tube on a cylinder core, onto which the sleeve is to be slipped; and a mounting device on the carrier tube for engaging the sleeve to mount the sleeve in a position, which is aligned coaxially with the carrying tube.

12. A device for handling sleeves for cylinders of printing presses, comprising:

a carrying tube, wherein a free end of the carrying tube has a centering piece for centering the carrying tube on a cylinder core, onto which the sleeve is to be slipped; and a mounting device on the carrier tube at one and thereof for engaging the sleeve to mount the sleeve in a position, which is aligned coaxially with the carrying tube.

13. A device of for handling sleeves for cylinders of printing presses, comprising:

a carrying tube, wherein a free end of the carrying tube has a centering piece for centering the carrying tube on a cylinder core, onto which the sleeve is to be slipped; and a mounting device on the carrier tube at one end thereof for engaging the sleeve to mount the sleeve in a position, which is aligned coaxially with the carrying tube, the mounting device being in the form of a stepped disk, which forms a stop for an end of the sleeve and includes a section which is reduced in diameter, and which engages the end of the sleeve.

14. A device for handling sleeves for cylinders of printing presses, comprising:

a carrying tube, wherein a free and of the carrying tube has a centering piece for centering the carrying tube on a cylinder core, onto which the sleeve is to be slipped;

a mounting device on the carrier tube for engaging the sleeve to mount the sleeve in a position, which aligned coaxially with the carrying tube; and a supporting element for the sleeve disposed on the carrying tube at a distance from the mounting device.

* * * * *